US007273273B2

(12) United States Patent
Calvini et al.

(10) Patent No.: US 7,273,273 B2
(45) Date of Patent: Sep. 25, 2007

(54) DEVICE FOR STORING AND SIMULTANEOUSLY REFILLING WITH DIFFERENT COLOR INKS A CARTRIDGE OF A COLOR PRINTHEAD

(75) Inventors: Eber Calvini, San Remo (IT); Paolo Poma, Ivrea (IT); Manlio Lombardo, Palermo (IT)

(73) Assignee: Telecom Italia S.p.A., Milan (IT)

( * ) Notice: Subject to any disclaimer, the term of this patent is extended or adjusted under 35 U.S.C. 154(b) by 127 days.

(21) Appl. No.: 10/553,709

(22) PCT Filed: Apr. 7, 2004

(86) PCT No.: PCT/IT2004/000183

§ 371 (c)(1),
(2), (4) Date: Oct. 17, 2005

(87) PCT Pub. No.: WO2004/091918

PCT Pub. Date: Oct. 28, 2004

(65) Prior Publication Data

US 2006/0227186 A1 Oct. 12, 2006

(30) Foreign Application Priority Data

Apr. 17, 2003 (IT) ..... TO2003A0302

(51) Int. Cl.
*B41J 2/175* (2006.01)

(52) U.S. Cl. ..... 347/86; 347/85

(58) Field of Classification Search ..... 347/85, 347/86, 87

See application file for complete search history.

(56) References Cited

U.S. PATENT DOCUMENTS

| | | | | |
|---|---|---|---|---|
| 4,831,389 | A * | 5/1989 | Chan | 347/86 |
| 6,042,224 | A * | 3/2000 | Oda et al. | 347/86 |
| 6,270,207 | B1 * | 8/2001 | Sasaki | 347/86 |
| 6,338,552 | B1 | 1/2002 | Sato et al. | |
| 6,880,921 | B2 * | 4/2005 | Aponte et al. | 347/86 |
| 6,905,198 | B2 * | 6/2005 | Studer et al. | 347/86 |

FOREIGN PATENT DOCUMENTS

| | | |
|---|---|---|
| EP | 0 605 183 A2 | 7/1994 |
| EP | 0 699 532 A2 | 3/1996 |
| GB | 492 579 A | 9/1938 |

* cited by examiner

*Primary Examiner*—Anh T. N. Vo
(74) *Attorney, Agent, or Firm*—Venable LLP; Robert Kinberg; Steven J. Schwarz

(57) ABSTRACT

A container in which is arranged a housing borne by an upper wall of the container suitable for storing a color cartridge to be refilled. The container has at least three tanks containing the different color inks. The three tanks are substantially shaped as concentrical cylinders. More particularly, the outer tank completely encompasses the intermediate tank and both are arranged concentrically around the central tank. In the operating position, i.e. with the container in the vertical position, the ink is contained in the bottom part of each of the tanks in corresponding feeding compartments. Each of the tanks extends upwardly, i.e. in the direction of the upper wall, forming corresponding back-flow compartments concentrical and disposed ring-like about the housing, each of which communicates freely with the corresponding feeding compartment below. The cartridge is fed by three capillary elements of a spongy material inserted in corresponding cylindrical pipes arranged vertically inside the container and attached at the top to the bottom wall of the housing. By inclining the container laterally, or turning it upside down, the inks flow into the back-flow compartments and no longer wet the capillary elements so that the transfer of ink through these stops.

7 Claims, 5 Drawing Sheets

DEVICE FOR STORING AND SIMULTANEOUSLY REFILLING WITH DIFFERENT COLOR INKS A CARTRIDGE OF A COLOR PRINTHEAD

CROSS REFERENCE TO RELATED APPLICATIONS

This application is a national phase application based on PCT/IT2004/000183, filed Apr. 7, 2004, which claims the priority of Italian Application No. TO2003A000302, filed Apr. 17, 2003, the content of which is incorporated herein by reference.

TECHNICAL FIELD

This invention relates to a device for storing/housing and for simultaneously refilling with different colour inks a cartridge of a colour printhead and also for automatically interrupting the feeding of ink when the device is incorrectly positioned.

BACKGROUND ART

In the state of the art, various solutions are known for refilling and housing colour cartridges for ink jet printheads. In particular, European patent No. 605183 discloses a similar device for housing and refilling with different colour inks at least one colour cartridge for a ink jet printhead; the device comprises a container, inside which there is a seat, suitable for accommodating a refillable colour cartridge, inserted through a top aperture; the colour cartridge, as is known, is internally divided into three compartments, each containing a spongy body suitable for being impregnated with ink of a given colour. The container also comprises a second chamber, located under the seat of the cartridge, and separated from the latter by a horizontal wall; the second chamber is divided into three compartments, each of which suitable for containing a different colour ink with which to refill the cartridge placed in its seat. In correspondence with each compartment is a cylindrical capillary element, supported by the horizontal wall, which has a first end immersed in the ink inside the second chamber and a second end protruding into the seat of the cartridge and suitable for being inserted in the corresponding compartment of the cartridge, in contact with the spongy body for transferring through capillarity the colour ink from the second chamber to the cartridge.

This device has the drawback that when the container is turned over on a side or turned upside down, for instance during transport, the capillary element remains in contact with the ink and continues transferring the ink to the cartridge not only through capillarity but also on account of the head of ink above the capillary element, therefore causing an overfilling of the cartridge with, as a result, ink flowing out of the cartridge. This drawback is most apparent in cases where the cartridge is not in its seat; in such situations, ink would drip in abundance both in the seat of the cartridge and outside the container.

DISCLOSURE OF THE INVENTION

The main object therefore of this invention is that of producing a device for simultaneously refilling with different colour inks a cartridge of a colour printhead, stored or housed in the device itself, without the drawback mentioned above.

Another object of this invention is to produce a refilling device suitable for refilling an empty cartridge simultaneously with three different colour inks, solely and exclusively when the device is in the vertical position.

Another object of the invention is to avoid any dripping or running of ink in a device for storing or housing and simultaneously refilling with different colour inks a cartridge of a colour printhead, by automatically interrupting the feeding of ink, when the device is incorrectly positioned.

Yet another object of the invention is to produce a device for refilling with different colour inks a cartridge stored or housed in the device, avoiding overfilling of the same cartridge and/or ink running in the seat of the cartridge, when the refilling device is overturned on a side or upside down.

Therefore in accordance with the planned objects of this invention, a device is proposed for storing/housing and simultaneously refilling with different colour inks a colour cartridge of a printhead, which comprises a container, in which there is a seat for the cartridge to be refilled and at least three tanks for inks of different colours, each tank being associated with ink refilling means, suitable for transferring through capillarity the ink of each colour from the corresponding tank to the cartridge, characterized in the way defined in the main claim.

This and other characteristics of the invention will appear more clearly from the following description of a preferred embodiment, provided by way of non-restricting example, with reference to the figures in the accompanying drawings.

BEST MODE FOR CARRYING OUT THE INVENTION

Figure 1:
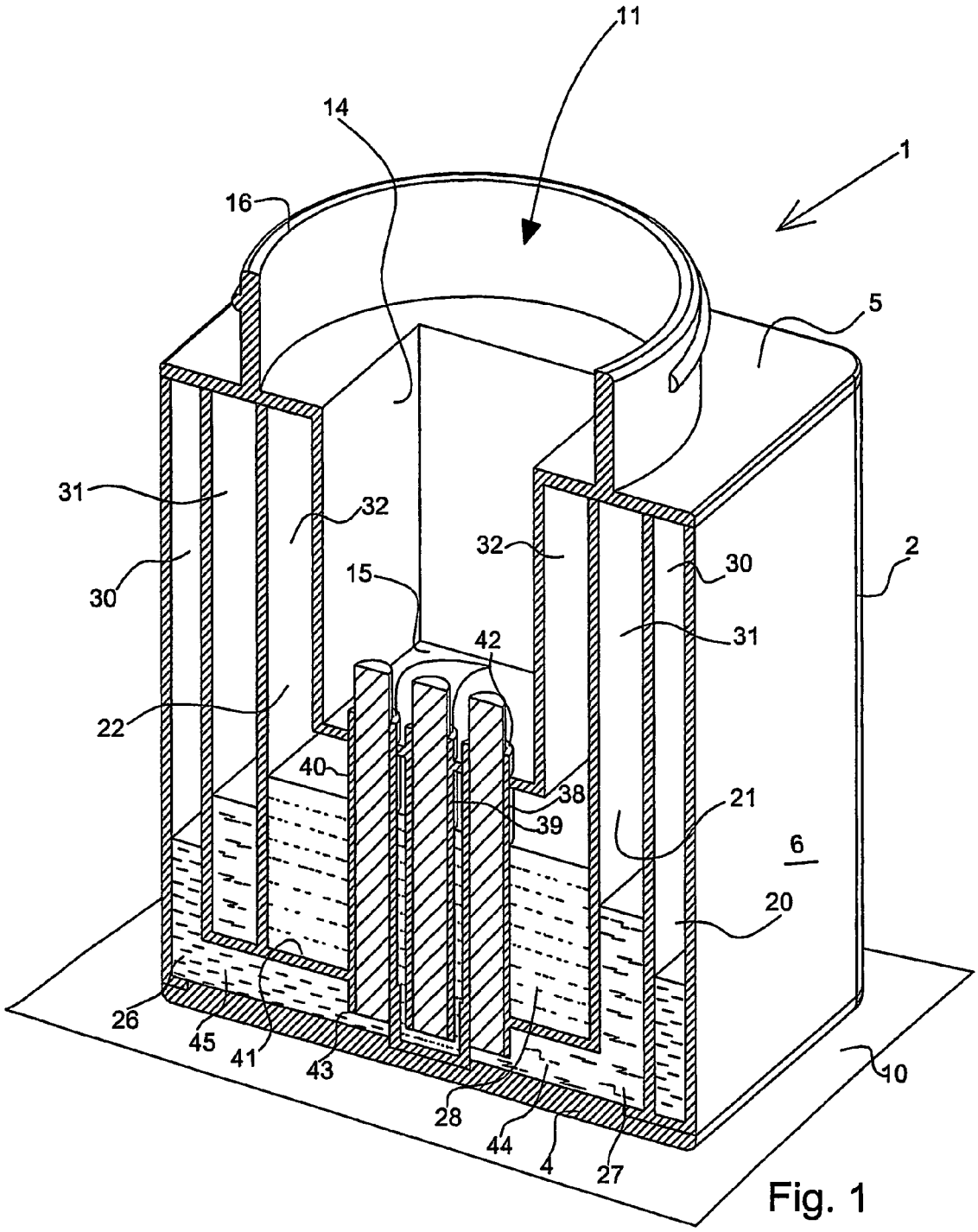
FIG. 1 represents a sectioned, perspective view of the device according to the invention.

Depicted in FIG. 1 is the device 1 for housing and simultaneously refilling with ink a colour cartridge 8 of a printhead, according to the invention, in which, indicated with the numeral 2, is a container made up of a bottom wall 4, a top wall 5, substantially parallel to the bottom wall 4, and at least one, external side wall 6, integrally linked with the other two walls 4 and 5.

Figure 2:
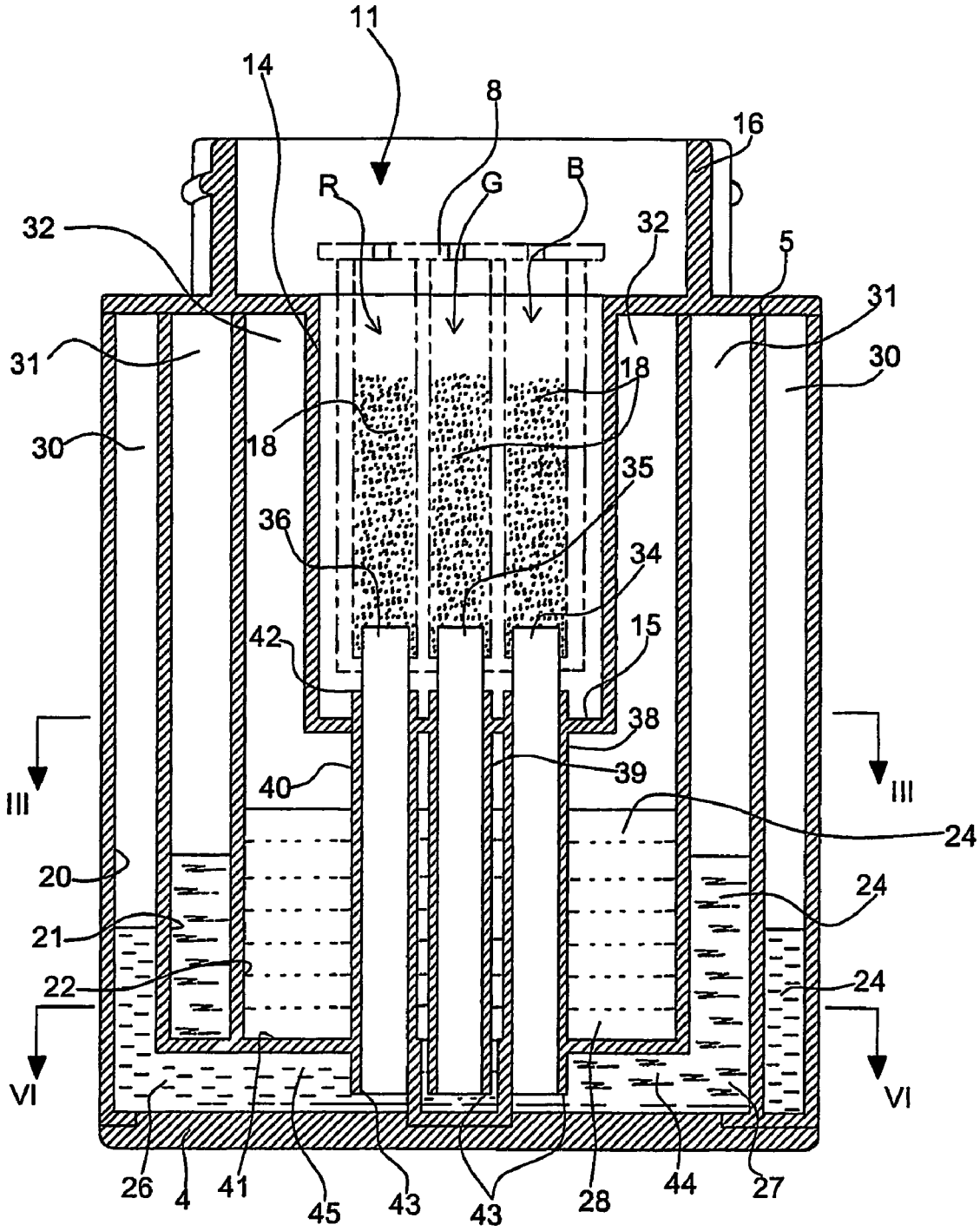
FIG. 2 is a vertical, front cross-section of the device of FIG. 1.

The bottom wall 4 is the support platform of the container 2 on a horizontal plane 10 on which to place the container itself in a vertical operating position, for refilling with ink the cartridge 8 (FIG. 2), as will be described in greater detail in the following.

Figure 3:
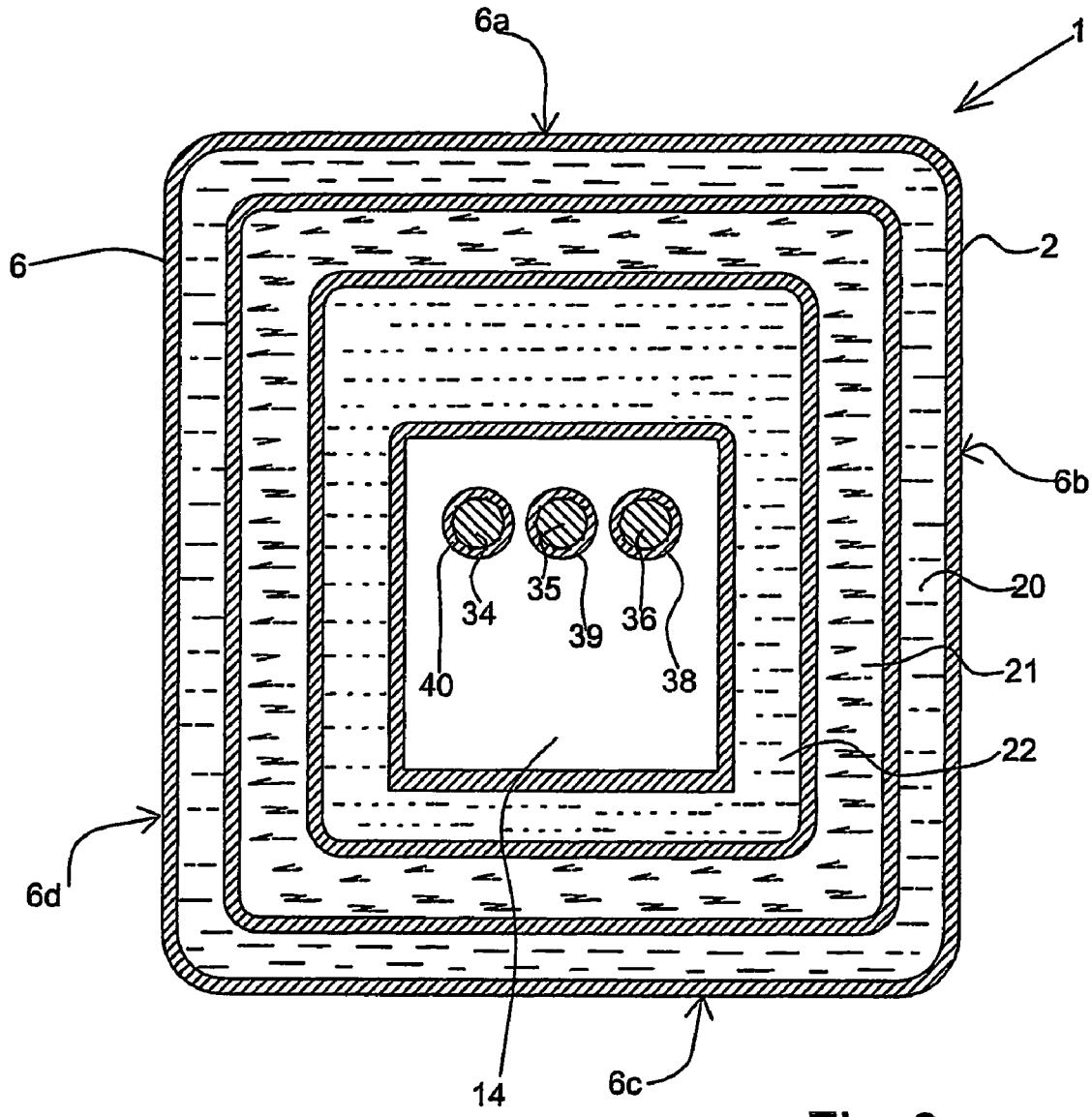
FIG. 3 is a horizontal cross-section taken along the line III-III of FIG. 2.

The container 2 may indiscriminately be made in a cylindrical shape, or as a parallelepiped, or a right-angled prism; in the first case, the side wall 6 will be made in a single, continuous piece, substantially shaped as a cylinder trunk; in the second case the side wall 6 will be made of various flat walls, four for instance, 6*a*, 6*b*, 6*c* and 6*d*, joined together and to the walls 4 and 5 (FIG. 3).

Made in the top wall 5 is an aperture 11, shaped conveniently to allow passage of the cartridge 8, when it has to be inserted in a substantially parallelepiped shape seat 14, made inside the container 2, and connected integrally to the top wall 5; the housing 14 extends inside the container 2 in the direction of the bottom wall 4 and is closed at the bottom by a bottom wall 15, which isolates the housing 14 from the inner space of the container 2.

Arranged around the aperture 11 is a circular collar 16 suitable for bearing a cover not depicted in the figures, with which to close the container 2 and maintain a sufficiently humid atmosphere inside it, thus preventing the ink from drying.

Figure 5:
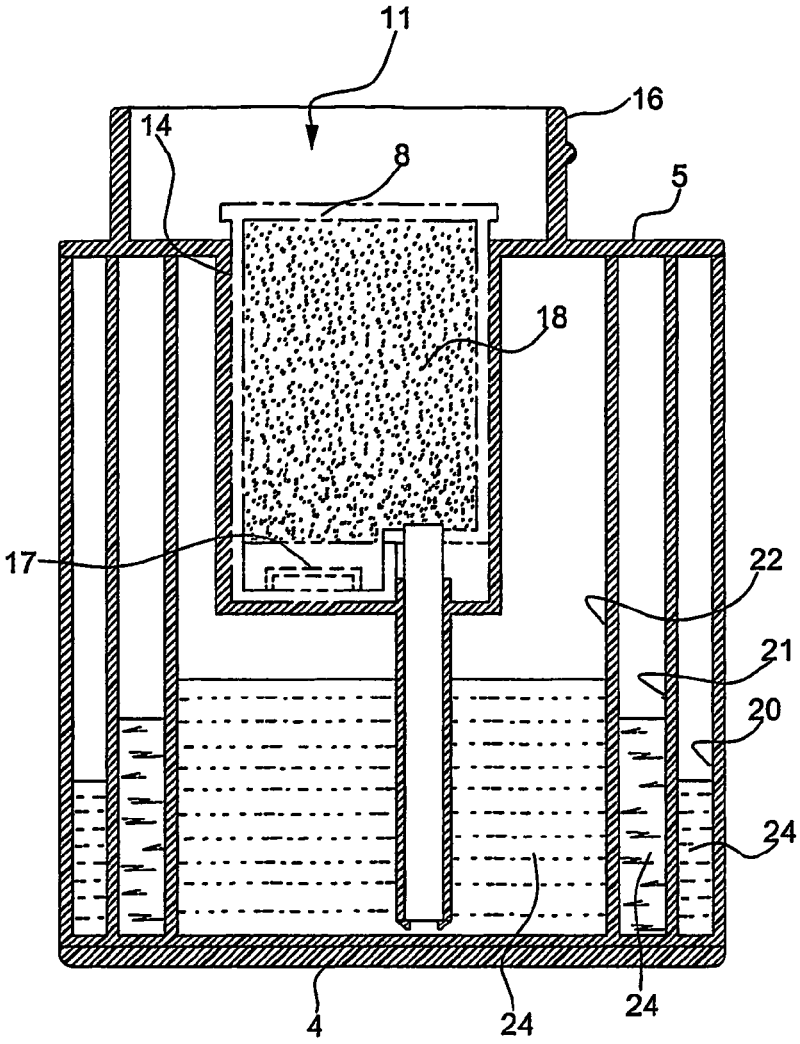
FIG. 5 is a vertical cross-section taken along the line V-V of FIG. 4.

The cartridge 8, in particular, according to a non-restrictive aspect of this invention, may be of the type in which a colour ink jet printhead 17 is integrated with the cartridge 8, as is shown by way of non-restrictive example in FIG. 5; alternatively, the cartridge 8 may be without a printhead and in this case, may be inserted in an appropriate seat, on board a colour printer having its own printhead. Both the mentioned types of cartridge are well known to those acquainted with the sector art, and will not therefore be described in detail in this description.

The colour cartridge 8 is divided internally into three R, G, B compartments (FIG. 2), each of which contains a spongy body 18, normally impregnated with the corresponding colour ink at the time of manufacture. When any one of the three R, G, B compartments of the cartridge 8, on completion of a printing cycle, has finished its original ink, it can be refilled repeatedly with the proper colour ink by means of the device 1, according to the invention.

In fact, according to an object of the present invention, the cartridge 8, out of ink, is inserted in the housing 14 where it may be refilled by means of a capillarity phenomenon, which simultaneously transfers the different colour inks to the cartridge 8, solely when the device 1 is disposed in an operating, or feeding, position, represented by the vertical position of the container 2, shown in FIG. 1, wherein the latter is set with its support base 4 on the horizontal plane 10.

The container 2 contains three tanks 20, 21, and 22 (FIG. 2), independent and separate from each other, each of which is suitable for containing corresponding, predetermined volumes of colour ink 24. For simplicity's sake, in the following description the three colour inks contained in the corresponding tanks 20, 21, 22, will be designated as a whole with a single numeral 24.

The three tanks 20, 21, 22 are substantially shaped as concentrical cylinders; more particularly, the outer tank 20 completely surrounds the intermediate tank 21, and both are disposed concentrically around the central tank 22, as represented in FIG. 3.

In the operating position, that is with the container 2 disposed in the vertical position, the ink 24 is contained in the bottom part of each of the tanks 20, 21 and 22, in corresponding feeding compartments 26, 27 and 28 (FIG. 1); in this position, each of the inks 24 occupies the corresponding feeding compartment 26, 27 and 28, to a pre-established level with respect to the support base 4, corresponding to a predetermined volume of colour ink, for example of approximately 200 ml and enough to completely refill, several times, the respective compartment of the cartridge 8.

In accordance with the main aspect of the present invention, each of the tanks 20, 21 and 22 extends upwardly, i.e. in the direction of the top wall 5, forming corresponding back-flow compartments 30, 31 and 32 (FIGS. 1, 2); each of these back-flow compartments communicates freely with the corresponding feeding compartment below 26, 27 and 28.

Each of the three tanks 20, 21 and 22 is sized such as to have a volume substantially not less than the predetermined volume of ink contained in the corresponding feeding compartments 26, 27 and 28.

As a result when the container 2 is tilted laterally on any one side, all three inks contained in the tanks 20, 21 and 22 can flow towards the corresponding back-flow compartments 30, 31 and 32, thus greatly reducing the quantity of ink remaining in the feeding compartments 26, 27 and 28.

Feeding of the cartridge 8 is obtained thanks to refilling members, which comprise three capillary elements 34, 35 and 36, consisting of preformed cylinders of spongy material with communicating cells, inserted in corresponding cylindrical pipes 38, 39, and 40, of impermeable material. Each pipe is disposed vertically inside the container 2 and is attached at the top to the bottom wall 15 of the housing 14 and at the bottom to the bottom wall 41 of the innermost tank, the central tank 20 in FIG. 1.

The three pipes 38, 39 and 40 are grouped together one adjacent to the other, and disposed in the container 2 in a position (FIG. 3) that is central and symmetrical with respect to the profile of the bottom wall 4.

The top end 42 of the pipes 38, 39 and 40 (FIG. 1) penetrates into the housing 14, whereas the bottom end 43 of the pipes protrudes respectively inside each feeding compartment 26, 27 and 28.

The capillary elements 34,35 and 36 protrude at the top from their respective pipes to a prefixed height, to penetrate into the respective R, G, B compartments of the cartridge 8 in contact with the sponges inside (FIG. 2), so as to transfer each colour ink by capillarity from the respective tank to the corresponding compartment of the cartridge 8.

Figure 6:
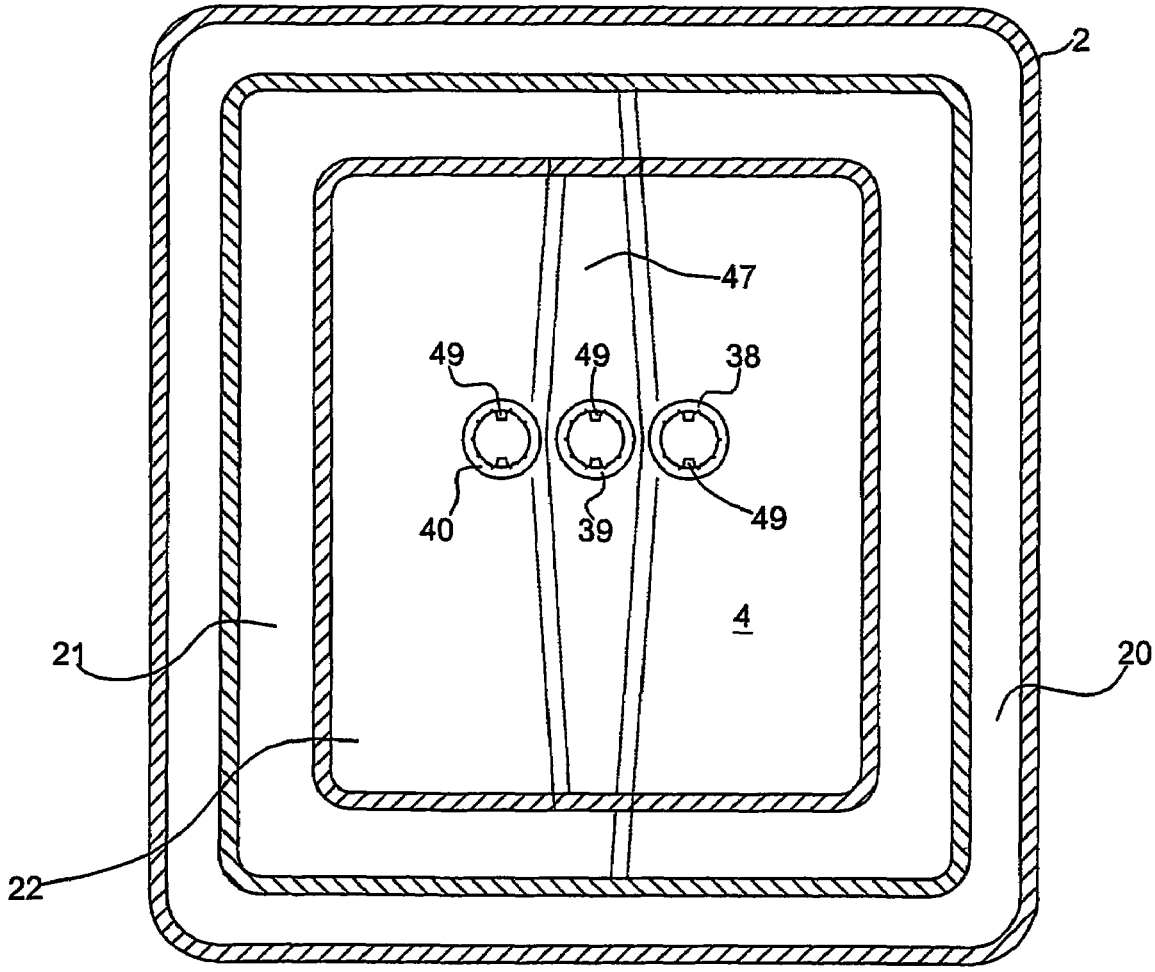
FIG. 6 is a horizontal cross-section taken along the line VI-VI of FIG. 2.

In the bottom part, the pipes extend beyond the bottom wall 41 of the central tank 22, to a short distance from the bottom wall 4 of the container 2, whereas the respective capillary elements are cut flush with the lower end 43 of the pipes; in particular, the pipe 40, belonging to the outer tank 20 and the pipe 38, belonging to the intermediate tank 21 (FIG. 1), respectively protrude into a first portion 44 and a second portion 45 of the tanks 20 and 21, said portions 44 and 45 extending partly and laterally below the bottom wall 41 of the central tank 22; the pipe 39 belonging to the central tank 22 protrudes inside a transverse channel 47 (FIG. 6) communicating with the central tank 22, and disposed on the bottom wall 4 of the container 2, said channel 47 separating the outer tank 20 from the intermediate tank 21.

Therefore when the container is correctly disposed in the vertical position, as defined above, each of the capillary elements 34, 35, 36 is immersed in the corresponding colour ink contained in each of the feeding compartments 26, 27, 28, and can efficaciously refill, thanks to their capillarity, the three compartments of the cartridge 8.

On the other hand, when the container 2 is turned over on any one of its sides, during transport for instance, the inks flow into the respective back-flow compartments 30, 31, and 32, wherein they collect at a level that does not lap against the lower end 43 of the pipes, i.e. of the capillary elements 34, 35, and 36, so that feeding of the inks is automatically interrupted, thus excluding the risk of overfeeding any compartment of the cartridge 8, and accordingly encouraging ink to exit from the cartridge. In this way, even when the cartridge 8 is not in the housing 14, there is no danger of ink flowing out.

Interruption of the feeding of inks is even more evident when the container 2 is turned upside down; in fact, in this position all the ink in the three feeding compartments flows into the corresponding back-flow compartments, leaving the capillary elements completely dry.

Figure 4:
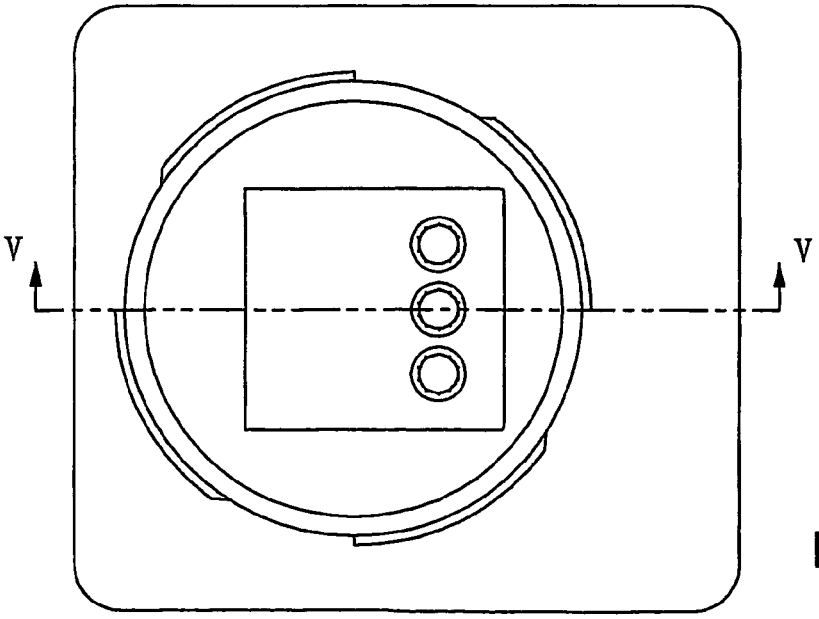
FIG. 4 is a view from above of the device of FIG. 1.

From the foregoing description, the advantages obtained from the device according to the present invention will be evident, with respect to similar solutions known in the state of the art, in that the device 1 described, by ensuring the simultaneous feeding of three different colour inks to the cartridge 8, solely and exclusively when the container 2 is in the vertical operating position, avoids the inks being transferred through the capillary elements 34, 35, 36, when the container 2 is placed on its side, or turned upside down (FIG. 4). As a matter of fact, when the container 2 is put in any position other than the vertical, for instance during transport, the capillary elements 34, 35, 36 remain separate from their respective inks, which flow into the back-flow compartments 30, 31, 32; in this position, the capillary elements 34, 35, 36 do not transfer the inks, avoiding any overfeeding of the cartridge 2, or spillage of ink inside the housing 14, in the absence of the cartridge 2.

It remains understood that changes may be made to the device for storing and simultaneously refilling with different colour inks a cartridge of a colour printhead, according to the invention, or parts substituted, without departing from the scope of the invention.

For example, in order to stabilize the hydrostatic pressure in each of the tanks 20, 21, 22 and in the back-flow compartments 30, 31, 32, the pipes 38, 39 and 40 (FIG. 6) may be provided with longitudinal grooves 49, which enable air to pass between the tanks and the R, G, B compartments of the cartridge 2.

The invention claimed is:

1. A device for storing and simultaneously refilling with different colour inks to a cartridge of a colour printhead, comprising:

a container in which are disposed a housing for said cartridge to be refilled and includes at least three independent tanks for inks of different colours, each tank being associated with a feeding member, cooperating with said cartridge for transferring the ink of each colour from the corresponding tank to said cartridge when said container is in the operating position, vertical with respect to a horizontal support plane, said tanks being arranged concentrically in a central position in said container each of said tanks being suitable for containing a predetermined quantity of colour ink, collected in a corresponding feeding compartment adjacent to a bottom wall of said container, and each of said tanks extending in the direction of a top wall of said container forming a corresponding back-flow compartment, communicating freely with the corresponding feeding compartment below, said back-flow compartments being suitable for receiving said colour inks, when said container is turned over on a side, or upside down, so that said feeding members emerge from said inks interrupting the feeding of said cartridge.

2. The device as in claim 1, wherein said tanks have a substantially cylindrical shape, and wherein an outer tank and an intermediate tank of said three tanks are arranged ring-like around a central tank.

3. The device as in claim 2, wherein said outer tank and said intermediate tank comprise a first and a second corresponding portion extending partly and laterally under a bottom wall of said central tank, and the lower ends of two of said capillary elements, associated with said outer and intermediate tanks, are immersed respectively in said first and second portion and the lower end of said capillary element associated with said central tank is immersed in a transverse channel communicating with said central tank and disposed on said bottom wall of the container, said channel separating said first lateral portion from said second lateral portion.

4. The device as in claim 1, wherein said back-flow compartments have a substantially cylindrical and concentric shape, and are arranged around said housing of said cartridge.

5. The device as in claim 1, wherein said feeding members comprise three capillary elements of substantially cylindrical shape, disposed in a central position in said container and are inserted in corresponding pipes attached to said housing, each pipe communicating respectively with a corresponding feeding compartment, said capillary elements being adapted for cooperating with said cartridge for transferring said colour ink from each of said feeding compartments to said compartments of said cartridge solely and exclusively when said container is in said vertical operating position.

6. The device as in claim 1, wherein each of said back-flow compartments presents a volume at least equal to the volume of each of said predetermined quantities of colour ink contained in each of said corresponding feeding compartments.

7. The device as in claim 1, wherein said back-flow compartments, said feeding compartments and said predetermined quantities of colour ink have their respective volumes proportionate in such a way that said feeding members are uncovered by said colour inks, when said container is in any position other than said vertical operating position, so that any dripping and/or running of ink through said feeding members is avoided.

* * * * *